US005642912A

United States Patent [19]

Parish, II

[11] Patent Number: 5,642,912

[45] Date of Patent: Jul. 1, 1997

[54] PULLING ATTACHMENT FOR PLASTIC PIPE AND SLIP LINING HEAD

[75] Inventor: Robert O. Parish, II, Cleveland, Tex.

[73] Assignee: TTI Trenchless Technologies, Inc., Conroe, Tex.

[21] Appl. No.: 327,556

[22] Filed: Oct. 24, 1994

[51] Int. Cl.[6] ..... E21B 31/12; B66C 1/10

[52] U.S. Cl. ..... 294/86.12; 294/86.25

[58] Field of Search ..... 294/1.1, 86.1, 294/86.4, 86.12, 86.22, 86.24, 86.25, 93, 94, 102.2; 405/154, 174, 184

[56] References Cited

U.S. PATENT DOCUMENTS

| | | | |
|---|---|---|---|
| 1,145,125 | 7/1915 | Davis | 294/86.25 |
| 1,163,561 | 12/1915 | Schildwachter | 294/86.1 |
| 1,721,024 | 7/1929 | Krell et al. | 294/102.2 |
| 1,739,601 | 12/1929 | Marble | 294/86.12 |
| 1,751,998 | 3/1930 | Hinderliter | 294/86.12 |
| 4,648,746 | 3/1987 | Abinett | 405/154 |
| 5,029,924 | 7/1991 | Stuckey | 294/86.25 |
| 5,094,496 | 3/1992 | King, Sr. | 294/86.25 |
| 5,197,773 | 3/1993 | Vick, Jr. | 294/86.25 |

*Primary Examiner*—Dean Kramer

[57] ABSTRACT

The present invention is directed to an attachment for a plastic pipe, usually polyethylene pipe, to a head for pulling the pipe into a sewer or other utility line. The present invention is also directed to a slip lining head. More specifically, the present invention is directed to a slip lining head which includes the unique attachment for a plastic pipe used in the repair/replacement of sewer and other utility lines.

12 Claims, 4 Drawing Sheets

PULLING ATTACHMENT FOR PLASTIC PIPE AND SLIP LINING HEAD

FIELD OF THE INVENTION

The present invention is directed to a unique attachment for plastic pipe to a head for pulling the plastic pipe. The present invention is further directed to a slip lining head used in the replacement of utility lines, such as sewer and water. More specifically, the present invention is directed to a slip lining head which includes the unique pulling attachment for a plastic, usually polyethylene, pipe which is pulled through an old pipe, usually concrete or tile, to repair/replace the old pipe.

BACKGROUND OF THE INVENTION

The replacement of utility lines is a significant part of the renewing of the infrastructure within the United States and other countries of the world. More and more this replacement work is done without digging trenches to remove the old pipes and installing the new pipes. Also the trend is to use polyethylene pipe as the replacement pipe. The present invention is directed to a unique pulling attachment for plastic, usually polyethylene, pipe and a slip lining head to pull the polyethylene pipe through the old pipe.

Slip lining of sewer lines with a polyethylene pipe has been an industry standard for some time. However, the approach has been essentially one of brute force. There are two significant problems with the approach taken to date with slip lining. The first is the manner in which the polyethylene pipe is attached to the slip lining head. The most common approach to the attachment of the polyethylene pipe to the head is with a set of collars which encircle the outside of the polyethylene pipe and are attached to the head with a series of bolts. The problem encountered in the field is the combined weight and bulk of the pipe and head in attempting to attach the two together. The pipe must be lifted and placed over the connecting sleeve of the head which has a plurality of threaded holes which must be aligned with the holes in the collars. A power drill is required to cut holes in the polyethylene pipe for the bolts to pass through the openings in the collars and be threaded into the holes of the sleeve of the head. What appears to be an easy operation, is a difficult operation when done in the field. In the field neither the pipe, which may be forty feet long or fused to a length of several hundred feet, nor the head can be rotated to make the connection but the person making the connection must move around and under the pipe to make the openings in the end of the plastic pipe for the bolts. The importance of the attachment can not be over emphasized since if the pipe pulls away from the head then the operation comes to a costly stop. The present invention overcomes the problems with the attachments now being used.

The second problem with slip lining heads presently used is that they were designed with brute force as the only criteria. In most instances the presently used heads are large and long. The shape of the pulling or front end of the presently used head is generally tapered with a long inclined plane. No apparent thought or consideration was given to the potential problems which might be encountered and providing any design solution to those problems in the construction of the slip lining heads which are presently used.

SUMMARY OF THE INVENTION

The present invention is directed to an attachment for a plastic pipe, usually polyethylene pipe, to a head for pulling the pipe into a sewer or other utility line. The present invention is also directed to a slip lining head. More specifically, the present invention is directed to a slip lining head which includes the unique attachment for a plastic pipe used in the repair/replacement of sewer and other utility lines.

BRIEF DESCRIPTION OF THE PREFERRED EMBODIMENTS

One aspect of the present invention is the attachment of a plastic, usually polyethylene, pipe to a head which is pulled through a utility line. The pulling of a polyethylene pipe though a sewer line is referred to in the industry as slip lining. The present invention is directed to a wedge attachment, one embodiment which utilizes a threaded wedge and a second embodiment which utilizes a piston actuated wedge, to attach the plastic pipe to a head.

Figure 1:
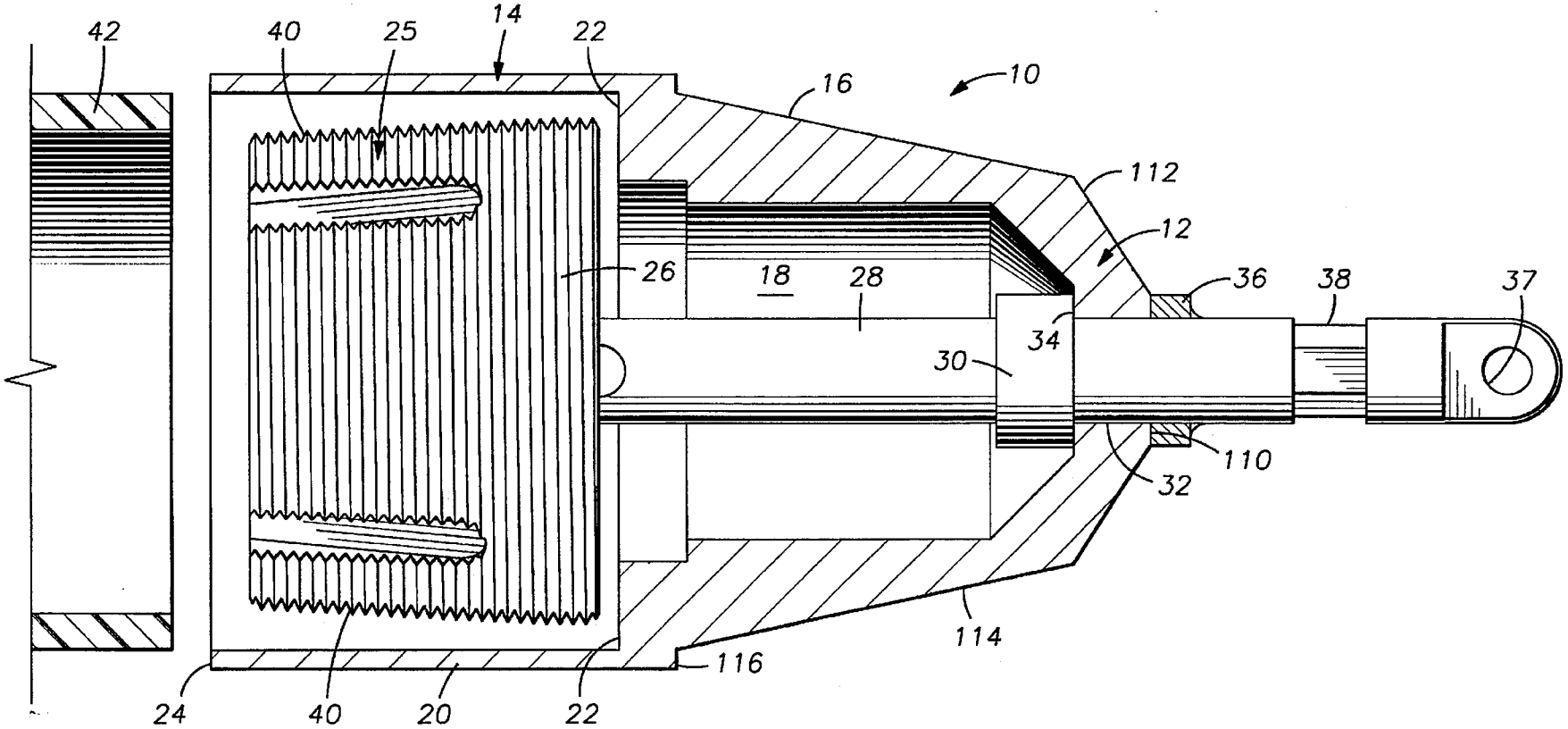
FIG. 1 is a cross-sectional view of one embodiment of an attachment for a plastic pipe to a head, a threaded wedge and a preferred embodiment of a slip lining head of the present invention.

Referring now to FIG. 1 which illustrates the threaded wedge mechanism for attaching plastic, specifically polyethylene, pipe to the head. Head 10 has a pulling portion or front end 12 and a back end 14. Head 10 has an outer body 16 and an inner cavity 18. The outer body 16 and the cavity 18 in the back end 14 form a cylindrical portion 20. Each head 10 will have dimensions designed for a specific outside diameter (O.D.) polyethylene pipe by having the inner diameter (I.D.) of the cylindrical portion 20 near that same diameter. In other words each head 10 has an I.D. of cylindrical portion 20 for a specific O.D. polyethylene pipe. Common to each head 10 however is the cylindrical portion 20. The cylindrical portion 20 of head 10 terminates on the inside nearest the front end 12 in a shoulder 22 and at the back end in the back surface 24 of body 16. The shape of the inner cavity 18 in the front end 12 of head 10 is not limited to that which is shown.

The threaded wedge 25 of this embodiment shown in FIG. 1 has a tapered self-threading tap 26 positioned in the cylindrical portion 20. Keyed to the tap 26 is a shaft 28 having a thrust block 30 fixed to the shaft 28. The shaft 28 slides through an opening 32 in the front end 12 of head 10 until the thrust block 30 and the inner surface 34 of the body 16 are in contact. The thrust block 30 is fixed on shaft 28 so that contact with inner surface 34 will occur with a space between the tap 26 and shoulder 22. A retainer 36 is slid over the shaft 28 and welded to the shaft 28 retaining the tap 26 in the cavity 18 of the body 16. The shaft 28 has a connection means such as a hole 37 to connect to a pulling cable or a head or other structure. The hole 37 may also be used to place a rod into to rotate the shaft 28. Alternatively or additionally the shaft 28 may have a plurality of flats 38 (four, six or eight) where a pipe wrench may be attached to rotate the shaft 28.

The tapered self-threading tap 26 has threads 40 at the outer surface of the tap 26. A typical design for tap 26 has four to eight threads per inch. The taper of the threads 40 on the tap 26 is such that the diameter at the end nearest shoulder 22 is greater than the I.D. of the plastic pipe to be attach to the head 10. The diameter of the tap 26 at the end nearest the back surface 24 of head 10 is ⅛" to 1" less than the I.D. of the plastic pipe.

To attach a plastic pipe 42 to the head 10, the end of a plastic pipe 42 is introduced into the cylindrical portion 20 of the head 10. The O.D. of the plastic pipe 42 is essentially the same as the I.D. of the cylindrical portion 20. The plastic pipe 42 enters the cylindrical portion 20 until the end of the pipe contacts the threads 40 of the tap 26. This contact occurs when the end of tap 26 nearest surface 24 has entered the inside of pipe 42. The shaft 28 is then rotated which in turn rotates tap 26. The rotation of the tap 26 inside plastic pipe 42 causes threads to be formed on the inside of the pipe 42 and also to draw the pipe further into the head 10. As the pipe 42 is drawn further and further into the head 10, the pipe 42 passes a point where besides threading the inside surface of the pipe 42, the pipe 42 is wedged or compressed between the tap 26 and the inside surface of cylindrical portion 20. The shaft 28 is given sufficient rotations as the pipe 42 is drawn into the head 10 to securely wedge the pipe 42 in the head 10. Since the coupling of the pipe 42 to the head 10 is usually done where there is space to provide sufficient force to rotate the shaft to obtain a secure wedge, longer sections of the pipe 42 can be pulled than heretofore pulled. One advantage of the threaded wedge attachment as illustrated in FIG. 1 is that the uncoupling of the head 10 from the pipe 42 can be done in a limited space. Space is needed only for a wrench to rotate the sleeve 28 in the opposite direction (counter clockwise). Once the wedging forces are released the continuing rotation of the shaft 28 quickly uncouples the tap 26 from the pipe 42 and the head 10 may be removed.

Figure 2:
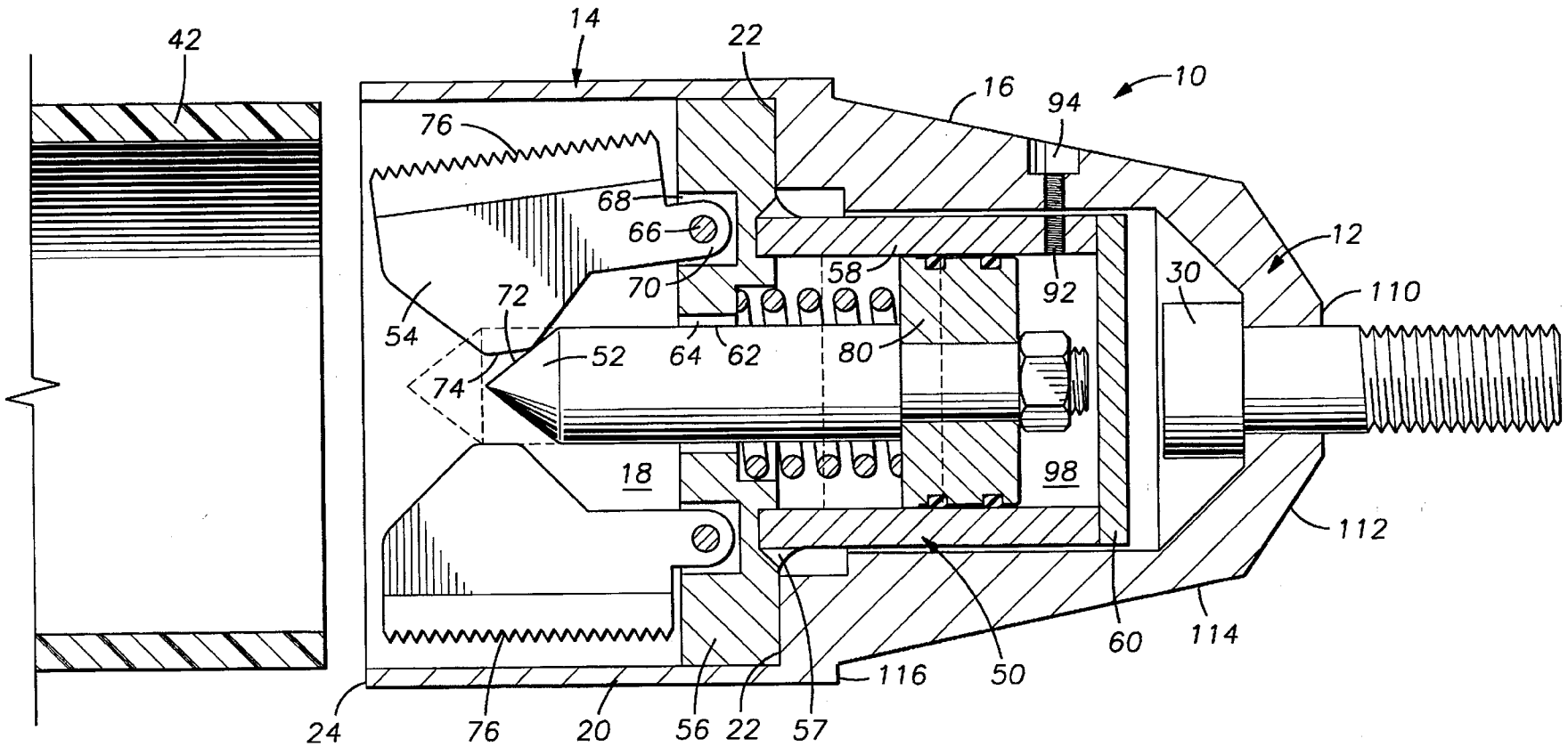
FIG. 2 is a cross-sectional view of a second embodiment of an attachment for a plastic pipe, a piston actuated wedge, in the preferred slip lining head of the present invention.
Figure 3:
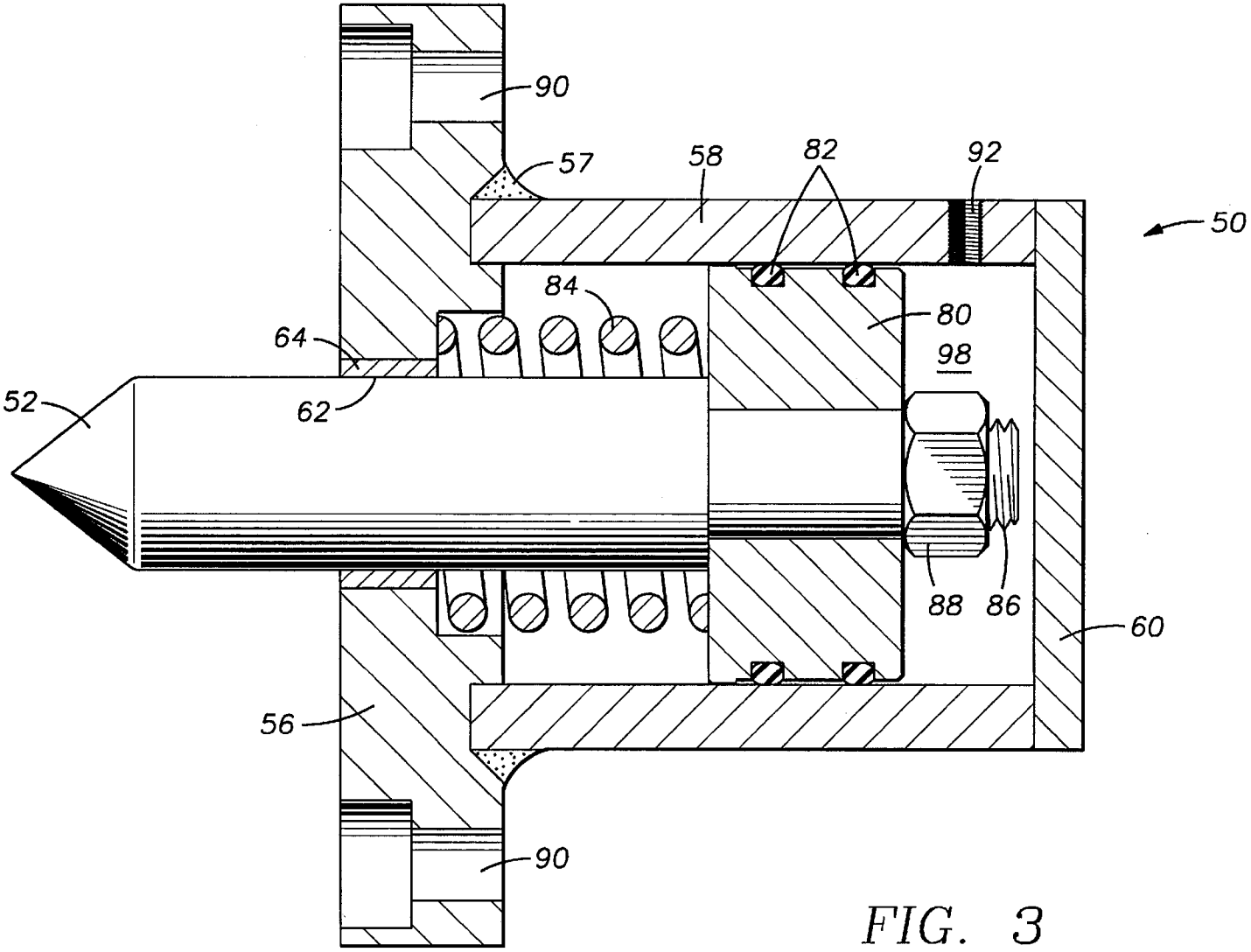
FIG. 3 is a cross-sectional view of the piston activated wedge rotated from the view of FIG. 2 to show a second fitting opening for operating the piston actuated wedge of the second embodiment attachment and the bolt openings for connecting the piston activated wedge to the slip lining head.

Referring now to the embodiment of FIG. 2, head 10 has a pulling port ion or front end 12 and a back end 14. Head 10 has an outer body 16 and an inner cavity 18. The outer body 16 and the cavity 18 in the back end 14 form a cylindrical portion 20. In this embodiment a piston actuated wedge 50 is inserted into the cavity 18 and seats against shoulder 22. Wedge 50 includes a shaft 52 with a tapered end and a pivotal die 54. When the tapered end or the inclined plane of shaft 52 is moved against the die 54, the die 54 moves outward in contact with the plastic pipe 42 and wedges or compresses the pipe 42 between the die 54 and cylindrical portion 20 of the head 10. The wedge 50 includes a back plate 56, a cylindrical housing 58 and an end plate 60. The back plate 56 has a central opening 62 with a bronze bushing 64 in which the tapered shaft 52 moves. The cylindrical housing 58 is welded 57 to one side of the back plate 56 and the end plate 60 is bolted (not shown) to the housing 58. On the side of the back plate 56 nearest the end surface 24 of head 10, dies 54 are mounted on pins 66 which pass through a machined slot 68 in back plate 56 and receive a tab 70 of die 54. In the cross-section of FIG. 2 two of four dies 54 are shown; however, the wedge 50 has at least two die 54, preferably three or four, equally spaced on back plate 56. The upper die 54 is shown in the position to receive the pipe 42 while the lower die is shown in the wedging or compression position. Each tab 70 of die 54 rotates in slot 68 as the inclined plane 72 of shaft 52 contacts the foot 74 of die 54 as the shaft 52 is moved toward the end surface 24 of head 10 (illustrated by the dotted lines and the change of position of the upper die 54 to the position of the lower die 54). The dimension of each die 54 from the tab 70 to the outer surface having teeth 76 may be different depending on the I.D. of the plastic pipe 42 being attached to head 10, the smaller the I.D. of the plastic pipe 42 the greater the length from the tab 70 to the teeth 76. The shaft 52 in this embodiment is moved by a piston 80 in the cylindrical body 58 of wedge 50. The piston 80 is a piston member having one or more, preferably two, O-rings 82 at the circumference of the piston member fitted on a reduced diameter portion of shaft 52. In the assembly of this embodiment of the piston actuated wedge 50 in the head 10, the wedge 50, as illustrated in FIG. 3, is first assembled. A spring 84 is inserted into the cylindrical body 58 and seats on back plate 56. The shaft 52 has a reduced diameter portion for the piston 80 followed by a threaded portion with threads 86. The piston member 80 is forced onto shaft 52 and secured by a nut 88 threaded on the end of shaft 52 to hold the piston 80 on the shaft 52. The shaft 52 with the piston member 80 attached thereto is inserted through the spring 84 and through the opening 62 of back plate 56. The end cap 60 is then bolted with a plurality of bolts (not shown) equally spaced on a circular center line. The dies 54 either have already been attached to the back plate 56 or are attached to the back plate 56. The piston actuated wedge 50 is then inserted into head 10 and bolted to contacting shoulder 22. As shown in FIG. 3, back plate 56 has machined openings 90 for cap screws to attach wedge 50 to the head 10. Also shown is an opening 92 which is drilled and tapped for a grease fitting. There are in fact two openings 92, one shown in FIG. 2 and the second in FIG. 3. As shown in FIG. 2, there is an opening 94 above each opening 92 in the assembled position. After wedge 50 is assembled into head 10, a grease fitting (not shown) is inserted into each opening 92, one fitting is a injection fitting and the second is a grease release fitting.

The plastic pipe 42 is attached the head 10, with the piston actuated wedge 50 shown in FIG. 2, by slipping the polyethylene pipe 42 into the cylindrical portion 20 of head 10 which contains the wedge 50. A grease gun is placed in contact with the injection grease fitting in one of the openings 94 and grease is injected into the chamber 98 between the piston 80 and the end cap 60. As the grease enters chamber 98, fills the chamber 98 in the assembly state as shown in FIG. 3 and further grease is injected, the piston 80 and shaft 52 are moved toward the end surface 24 of head 10. The inclined plane 72 of shaft 52 contacts the foot 74 of die 54 causing teeth 76 to contact, wedge and compress the pipe 42 between the die 54 and the cylindrical portion 20 of head 10. The pipe 42 is then attached to the head 10 such that lengths of 100' to 500' or more can be pulled by head 10. When it is desired to disengage the pipe 42 from the head 10, the release grease fitting is activated, and the grease is forced out one opening 92 into chamber 98 by the force of sprang 84 against piston 80. Once the grease fitting is activated, this operation only takes several minutes.

The attachment of the pipe 42 to the head 10 by either wedge 25 or 50 is completely independent of the outside structure of head 10 or the specific function of head 10. To make it absolutely clear, the pipe attachment structure of the present invention is not dependant on the outside structure of head 10 and need not be that as shown in FIGS. 1–3. The attachment head may be simply a block and be connected to another structure while requiring the attachment structure of the present invention for pulling the pipe. The specific structure for pulling the head is not limited to any specific structure, such as opening 37 in shaft 28 shown in FIG. 1 or the threaded connection 100 shown in FIG. 2. The attachment structure may be in a head connected to a joint of pipe stem or directly attached to another structure for example. The thrust block 30 need not be the specific structure shown in FIG. 2 but may be the head of a bolt, a nut or some other structure to which the pulling mechanism is attached. The thrust block 30 nevertheless is sized to transfer the pulling forces to the head 10 as it abutts the front end 12 of head 10.

The head 10 shown in FIGS. 1 and 2 is a unique slip lining head. The slip lining head 10 of the present invention is unique due to the outside surface of the head 10, which is now given specific attention and fully described. The front surface 110 of end 12 of head 10 is essentially a flat surface which is essentially 90° to the horizontal axis of the head 10. The next surface 112 has an angle greater than 45° and less than 70°, preferably about 57°, which makes the front end 12 of head 10 rather blunt. The tapered surface 114 has an angle greater than 10° but less than 25°, preferably about 12°, which makes the overall head 10 short and compact. The tapered surface 114 ends in a square shoulder 116. The square shoulder 116 is most significant in that it becomes a shearing surface. The square shoulder 116 is a shearing surface for taps or connections and objects such as tree roots or other obstacles which might be encountered when pulling the plastic pipe into an old concrete or tile pipe to replace/repair the old pipe.

Figure 4:
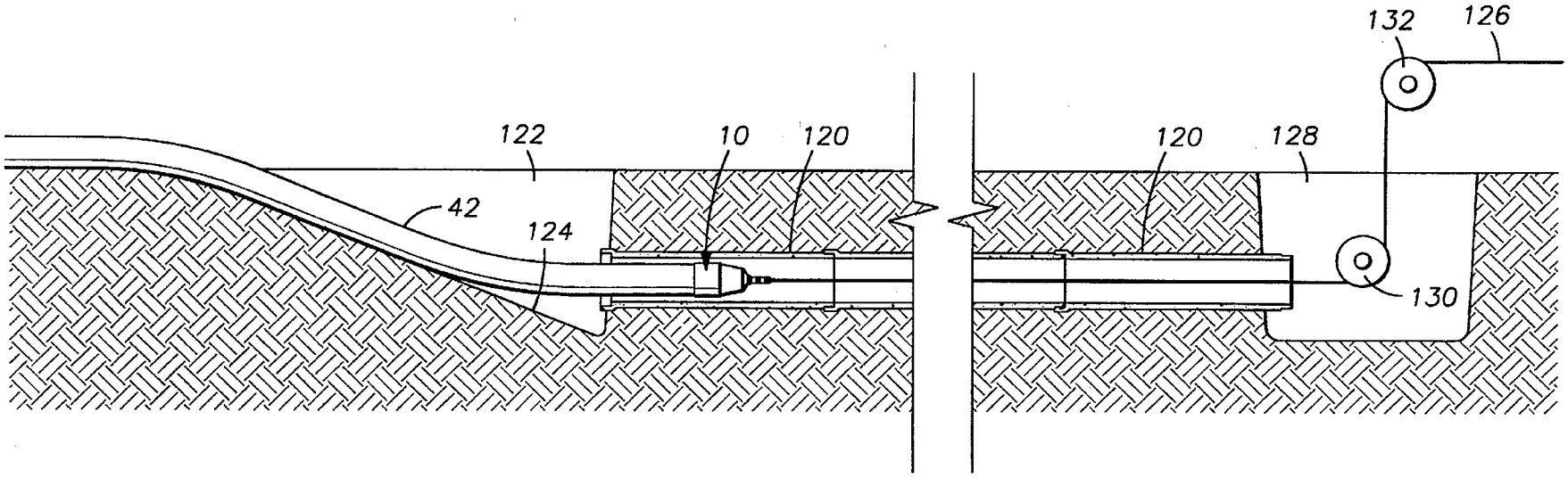
FIG. 4 is a schematic view of a slip lining operation showing a slip lining head of the present invention and the ancillary equipment used in pulling a plastic pipe through a sewer or other utility line.

Reference in now made to FIG. 4 which schematically illustrates a slip lining operation. In the replacement or repair of old concrete or tile sewer lines a polyethylene pipe is pulled through the old pipe. The length of polyethylene pipe may be from tens of feet to several hundred feet. With the head 10 of the present invention and the wedge attachments, either 25 as illustrated in FIG. 1 or 50 as illustrated in FIG. 2, lengths of polyethylene pipe of several hundred to five hundred feet or more may be pulled through an old pipe. Referring now to FIG. 4, an old concrete pipe 120 is shown. The concrete pipe 120 is of the bell and taper construction, meaning that one end of the concrete pipe has an enlarged portion or bell into which the tapered end of another length of pipe is inserted. Over the years the concrete pipe 120 has corroded or eroded such that the top surface of the pipe breaks and falls into the sewer line or the sections of pipe move and a tapered end will fall out of the adjacent bell. Whatever the specific problems, a new sewer line is needed and it is necessary to replace/repair the line without digging the old line up. The building of structures, fences or the number of trees near or over the old line may be reasons for not digging the old line up with a backhoe or other power equipment. The current practice is to pull a polyethylene pipe through the old sewer line and this operation is called slip lining. The old concrete pipe 120 or sewer line is located. At one end of the pipe 120, a trench 122 is dug with a backhoe with a sloping surface 124. The polyethylene pipe 42 is butt fused on the ground surface. Lengths up to forty feet of the polyethylene pipe are fused together to form one continuous pipe 42. The pipe 42 is attached to a head 10 on the surface. In preparation for the polyethylene pipe 42, a cable 126 is installed in the old pipe 120. This may be done by floating a string, such as nylon fishing cord, followed by pulling a rope and the rope pulling the cable from the trench 122 to a pit or manhole 128 at the other end of the operation. In the pit or manhole 128 is a pulley 130 and another pulley 132 on the surface. The end of the cable is attached to a winch (not shown). The cable 126 is attached to the head 10 and the head 10 is centered into the old pipe 120. Pulling is then commenced with the cable 126 pulling the head 10 which has the polyethylene pipe 42 attached. The distance the new pipe 42 is pulled may be several feet to five hundred feet or more. This operation is called slip lining in the waste water replacement/repair business.

The head 10 of the present invention has shown that the tendencies to hang-up or get wedged in the old pipe 120 are overcome by the design of the outside surface of the head. It is to be understood that the preferred head 10 of the present invention not only has the outside features set forth hereinabove but also has one of the attachment wedges 25 or 50 described. A head having both features was able to pull polyethylene pipe eight hundred feet (800') in the time that an old slip lining head could pull only 200'. The most significant factor was the time to attach the pipe 42 to the head 10 and the time to disengage the pipe 42 from the head 10 after the head 10 had been pulled from the trench 122 into the pit or manhole 128. One man taking no more than five minutes to attach and another five minutes to disengage the pipe 42 to the head 10 of the present invention rather than an hour or more for each operation with the attachments used heretofore.

I claim:

1. An attachment for attaching plastic pipe to a pulling head comprising:

a body having an inner cavity, said body having a front end and a back end and a cylindrical portion with an inside diameter which is essentially the same as the outside diameter of said pipe; and a wedging means located in said cavity which rotates within said body and moves relative to said body and enters said pipe and wedges said pipe against said cylindrical portion of said body, said wedging means comprising a self-threading tap located within said cylindrical portion of said body;

a rotatable shaft fixed to said tap and extending through said front end of and rotatable relative to said body; and means on said shaft to retain said tap within said cylindrical portion of said body.

2. An attachment according to claim 1 wherein said shaft has means for pulling said attachment.

3. A slip lining head comprising:

a body having a front end and a back end and having two outside surfaces which are inclined to the horizontal axis of said body, said surface nearest said front end having an angle greater than 45° and less than 70° and said second surface having an angle greater than 10° and less than 25°, said second surface terminating nearest said back end in a square shoulder, said body having an inner cavity; and means within said cavity for attaching a polyolefin pipe.

4. A slip lining head according to claim 3 wherein said inclined surface nearest said front end is about 57° and said second surface is about 12°.

5. A slip lining head according to claim 3 wherein said body has a cylindrical portion with an inside diameter which is essentially the same as the outside diameter of said pipe; and wedging means located in said cavity which moves relative to said body and enters said pipe and wedges said pipe against said cylindrical portion of said body.

6. A slip lining head for pulling a plastic pipe comprising:

a body having a front end and a back end and having two outside surfaces which are inclined to the horizontal axis of said body, said surface nearest said front end having an angle greater than 45° and less than 70° and said second surface having an angle greater than 10° and less than 25°, said second surface terminating nearest said back end in a square shoulder; said body having an inner cavity which forms a cylindrical portion at said back end with an inside diameter which is essentially the same as the outside diameter of said pipe; and a wedging means located in said cavity which moves relative to said body and enters said pipe and wedges said pipe against said cylindrical portion of said body.

7. A slip lining head according to claim 6 wherein said wedging means is a threaded wedge which rotates within said body.

8. A slip lining head according to claim 7 wherein said body has a front end and a back end and said threaded wedge comprises a self-threading tap located within said cylindrical portion of said body;

a rotatable shaft fixed to said tap and extending through said front end of and rotatable relative to said body; and means on said shaft to retain said tap within said cylindrical portion of said body.

9. A slip lining head according to claim 8 wherein said shaft has means for pulling said head.

10. A slip lining head according to claim 6 wherein said wedging means is a piston actuated wedge.

11. A slip lining head according to claim 10 wherein said piston actuated wedge comprises a shaft with one tapered end;

a back plate having a plurality of pivotal dies on one side and a cylindrical housing closed by an end plate on the other side of said back plate;

a piston on said shaft and located in said cylindrical housing, said piston, cylindrical housing and end plate forming a chamber.

12. A slip lining head according to claim 11 further including grease fitting in openings to said chamber.

* * * * *